US005676266A

United States Patent [19]

Kurtz

[11] Patent Number: 5,676,266

[45] Date of Patent: Oct. 14, 1997

[54] DUAL AIR LINE ARRANGEMENT FOR ROTARY/BOTTOM DUMP COAL CAR

[75] Inventor: William E. Kurtz, Johnstown, Pa.

[73] Assignee: Johnstown America Corporation, Johnstown, Pa.

[21] Appl. No.: 595,390

[22] Filed: Feb. 1, 1996

[51] Int. Cl.[6] ..... B61G 5/08

[52] U.S. Cl. ..... 213/76; 105/238.1; 105/355; 280/421

[58] Field of Search ..... 213/76; 105/4.1, 105/238.1, 239, 286, 355, 463.1; 280/421

[56] References Cited

U.S. PATENT DOCUMENTS

| | | | |
|---|---|---|---|
| 2,247,677 | 7/1941 | Van Dorn | 213/76 |
| 3,387,714 | 6/1968 | Dawson | 213/76 |
| 3,556,314 | 1/1971 | Punwani | 213/76 |
| 3,591,017 | 7/1971 | Cope | 213/76 |
| 3,599,665 | 8/1971 | Dwyer, Jr. | 213/76 |
| 3,662,899 | 5/1972 | Randolph et al. | 213/76 |
| 4,813,555 | 3/1989 | Cripe et al. | 213/76 |
| 5,480,042 | 1/1996 | Engle | 213/76 |

*Primary Examiner*—S. Joseph Morano
*Attorney, Agent, or Firm*—Myers & Associates, Ltd.

[57] ABSTRACT

A rail car having dual air hose connections at each end at upper and lower positions. The dual air hose connection provides universal connectability between adjacent cars having a single connection hose having ends at either an upper or lower position.

6 Claims, 3 Drawing Sheets

DUAL AIR LINE ARRANGEMENT FOR ROTARY/BOTTOM DUMP COAL CAR

BACKGROUND OF THE INVENTION

1. Field of the Invention

This invention relates in general to railcars and more particularly, to rail cars having auxiliary air lines.

2. Summary of the Prior Art

Hopper rail cars have long been used to carry bulk material, such as coal and the like. Two types of discharge systems are commonly used in such rail cars. One of the dumping techniques operates to rotate the car, while other designs employ a bottom dump system, with or without the capability of being rotary dumped. In many of such rail cars, an auxiliary air supply system is used to operate the doors of the car, through an auxiliary pneumatic hose line connected between adjacent cars. In many of the rail cars of these types, with a bottom/rotary dump discharge, the auxiliary air line is located with the hose end at a low position near the coupler. In other types of cars having a bottom/rotary dump mechanism, the connecting end of the auxiliary air line is situated at a high position on the ends of the rail car.

It is desirable that a rail car having an auxiliary air connection hose at a lower position be readily connectable to an adjacent rail car having a hose end at a high position. Due to the different vertical location of hose ends of the adjacent rail cars, however, a lower hose end can not be easily coupled with a car having an upper hose end. Therefore, it is desirable to provide an improved connection technique by which rail cars having upper and lower auxiliary hose ends can be easily coupled together and intermixed.

SUMMARY OF THE INVENTION

It is therefore an objective of the present invention to provide an improved air line hose arrangement incorporating a dual air line hose system, permitting high and low hose ends of adjacent cars to be readily interconnected. The invention of the application employ a universal connection technique to provide greater efficiency of coupling air hoses of rail cars, requiring high and/or low connections.

DESCRIPTION OF THE PREFERRED EMBODIMENT

Figure 1:
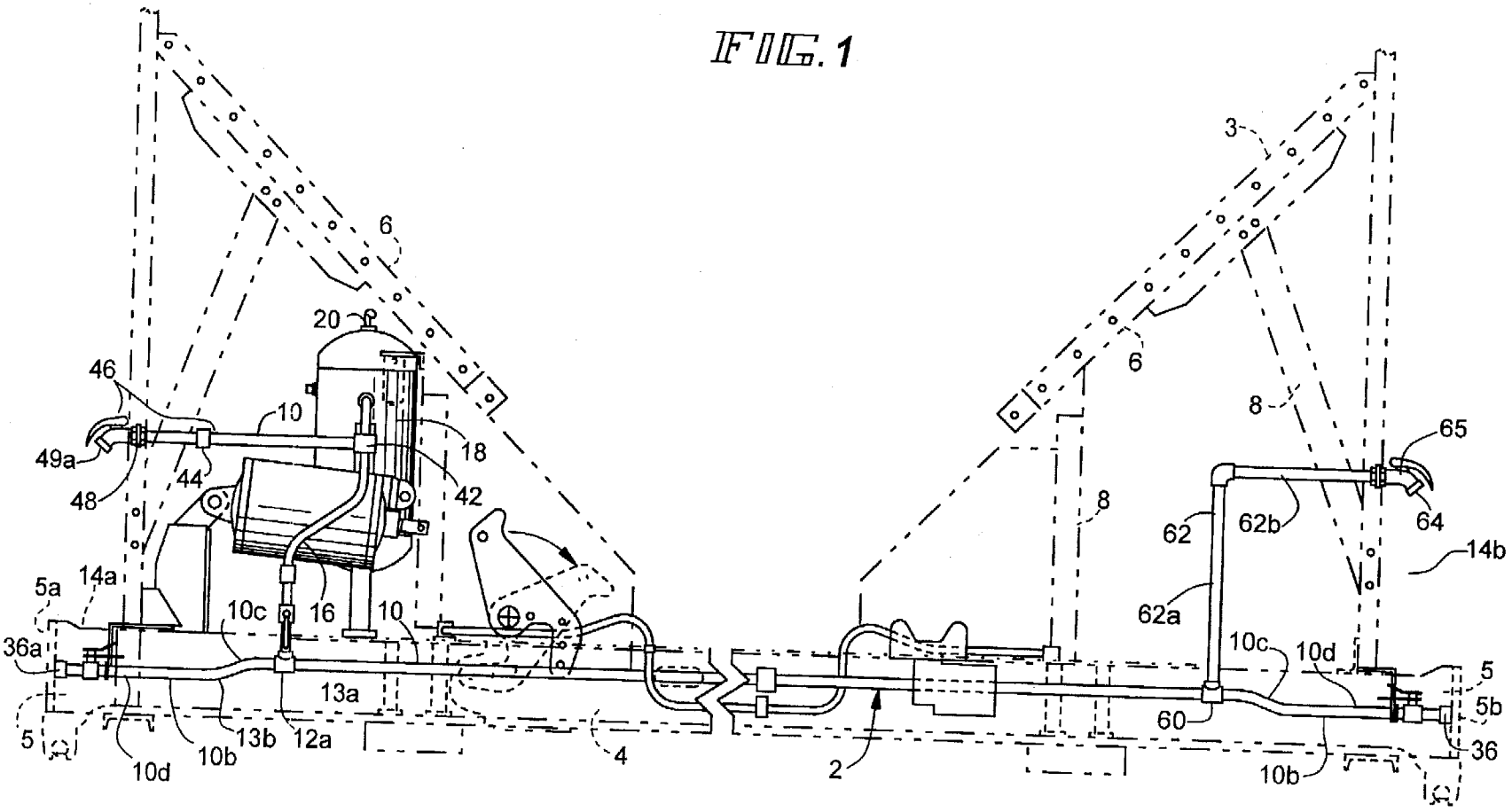
FIG. 1 is a partial side elevational view of a rail car of having the dual auxiliary air line ends of invention.
Figure 2:
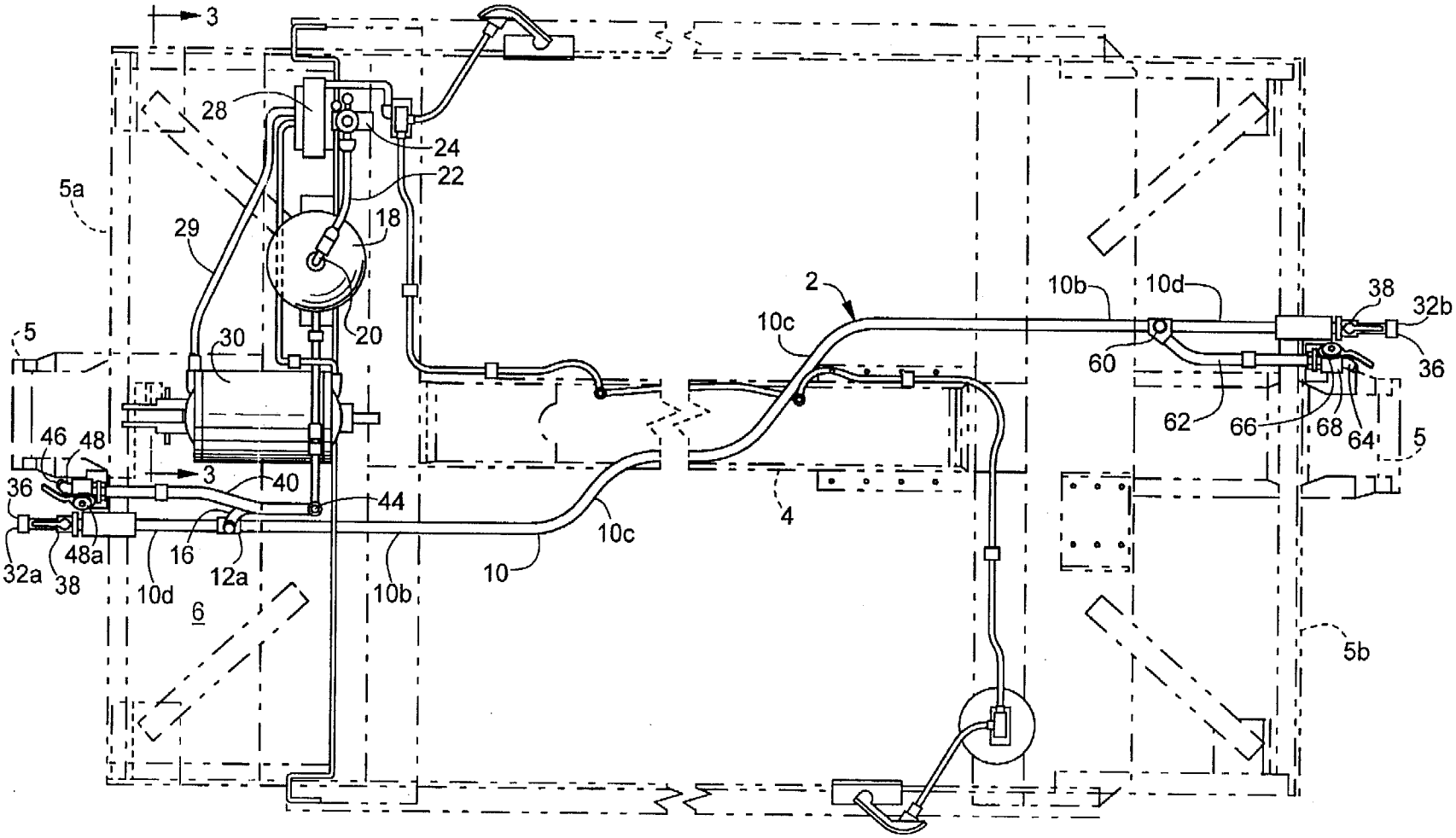
FIG. 2 is a partial and elevational view, with parts in section, taken along lines 3—3 of FIG. 2.
Figure 3:
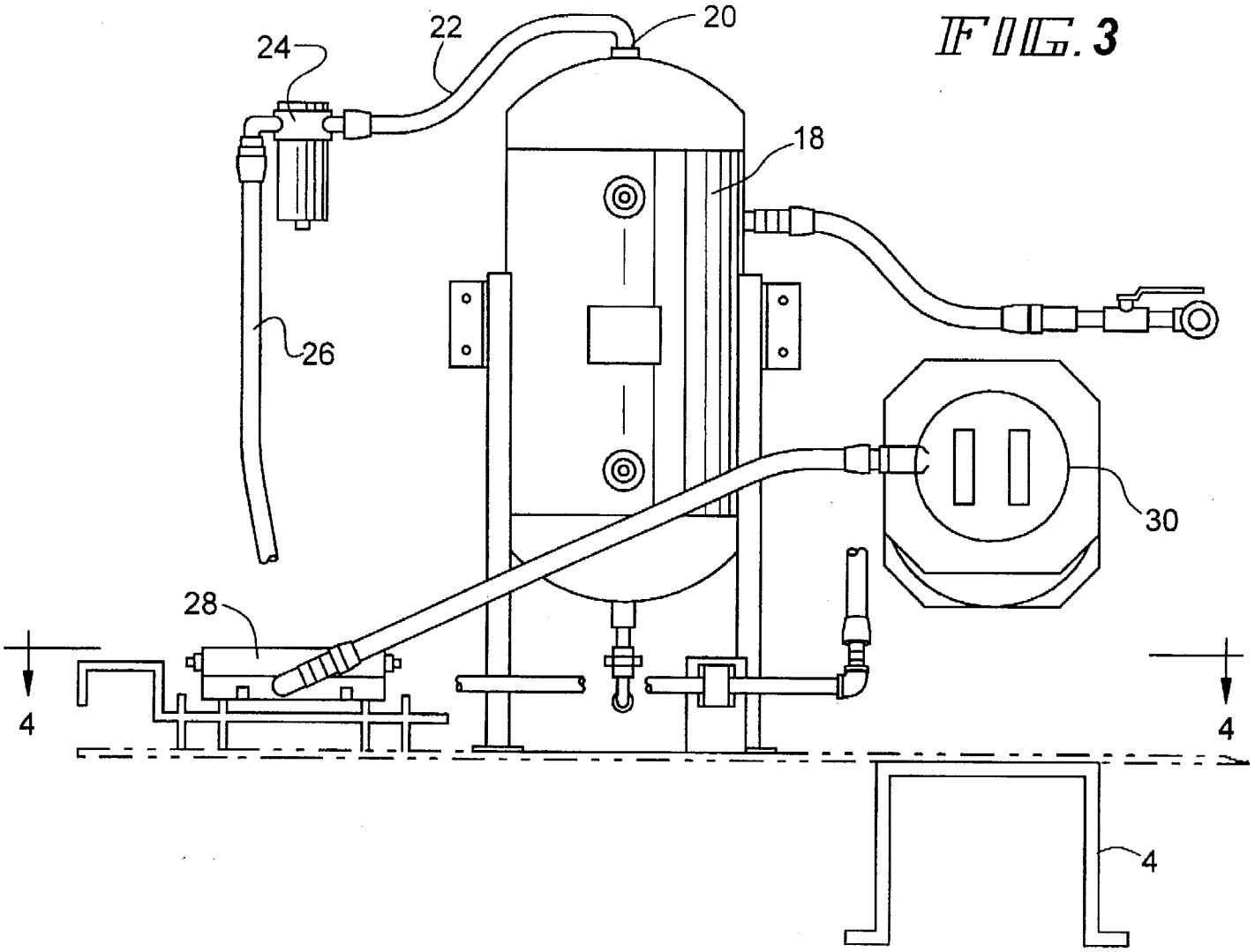
FIG. 3 is a partial and elevational view, with parts in section, taken along lines 3—3 of FIG.

Referring now to FIGS. 1–3, there is illustrated the dual air line end hose arrangement of the invention, generally illustrated by reference numeral 2, for use on any type of rail car 3 for handling granulate material (portion of which is shown) or other cars capable of bottom and rotary dumping, both techniques being well known in the art. In FIGS. 1 and 2, a longitudinally extending center sill 4 having strikers 5 at ends 5*a*, 5*b* of rail car 2 is shown and is adapted to be supported by a plurality of truck assemblies (not shown) in a conventional manner. Further in FIGS. 1 and 2, sloped end walls 6 and bolster assemblies 8 are shown in phantom mounted above the center sill 4 to form a portion of the hopper compartment as is well known. In a bottom discharge type of a rail car, a plurality of chutes (not shown) are provided having pneumatically operated doors controlled by a supply of air through auxiliary pneumatic line 10 of the dual air line end hose arrangement 2.

The auxiliary pneumatic line 10 extends substantially the length of the car longitudinally along the length of the rail car. Although not intended to be so limited and as in some cars, the central portion 10*a* of air line 10 is clamped by spaced clamps 11 within the center sill 4 as best seen in FIGS. 1–3. As further shown in FIGS. 1 and 2, the end portions 10*b* of the auxiliary air line 10 laterally flare outward through center sill 4 at section 10*c* and terminate at each end with a straight section 10*d* extending in an offset, but generally parallel relationship to the centerline of the center sill 4. It is within the scope of the invention, however, to alternatively position the auxiliary air line on the side sill or any other structure of the body, if appropriate. As seen in FIGS. 1 and 2, a welded tee 12*a* is connected to the air line 10 and at end 5*a* of the rail car 3. A vertical hose or airline 16 extends upward from welded tee 12*a* to an air reservoir tank 18 which typically has, for example, a capacity of 30 gallons. The tank 18 is fitted with a 90° street elbow 20 to which a hose 22 extends to air filter 24 (FIGS. 2 and 4). A vertical hose or airline 26 extends downward to conventional control valve 28. The control valve 28 is connected to a pneumatic cylinder 30 shown in FIGS. 1, 2, and 3 which operates the doors of rail car 3 in a known manner.

As seen at opposite end 5*b* of the rail car in FIG. 2, the end portion 10*b* of the auxiliary air line is offset on the opposite side of center sill 4 in relation to end portion 10*b* at car end 5*a*. The hose ends 32*a* and 32*b* of the auxiliary air line 10 terminate at lower positions adjacent the end of striker 5 and are provided with fittings 36 to provide a lower air hose connection. A stop cock valve 38 is provided in auxiliary air line 10 adjacent its respective ends 32*a* and 32*b* which is closed in absence of a connection.

As illustrated in FIGS. 1 and 2, an upper auxiliary air line 40 is connected to auxiliary air line 10 through a tee 42 in air line 16 at end 5*a* of the car. The air line 40 includes an coupling 44 and air line section 46 extending substantially parallel and above lower end air hose section 10*d* in a laterally offset relationship as seen in FIG. 2. A fitting 49*a* is affixed to air line end 49 and is arranged to be connected to an upper auxiliary air line of an adjacent coupled car through an external hose line. The fitting 48 may be provided with an on/off valve 48*a*.

At car end 5*b*, a tee 60 is provided in auxiliary air line 10. An air line 62, having right angle sections 62*a*, 62*b*, extends upward and outward to form a hose end 64 at an upper position, laterally offset from lower hose end 36. A stop cock valve 66 is provided to open and close air line 62 as required. A threaded stop cock 65 is affixed to air line 62*b* at the hose end 64 for connection to an external hose line.

In use of the invention, adjacent coupled rail cars may be universally interconnected, i.e. rotary dump cars having an upper auxiliary air hose with cars having a lower hose. The respective valves of the unconnected one of the dual air hose end at each end is closed, while the valves of the connected lines are opened.

What is claimed is:

1. A rail car having an auxiliary air hose adapted to being connected to an auxiliary hose of an adjacent coupled rail car comprising a rail car body having opposite ends and a center sill and extending along a longitudinal axis, pneumatic hose means being mounted on said rail car body, said pneumatic hose means having a pair of hose connection ends at each of said ends of said rail car body; and one of said pair of hose connection ends is mounted at an upper position of said car body above the other of said hose ends at each end of the car body;

said one of said hose connection ends being vertically above said center sill.

2. The rail car according to claim 1 wherein said pair of hose connection ends are arranged to be selectively connected to an external air hose extending to the adjacent coupled car.

3. A rail car having an auxiliary, air hose being adapted to being connected to an auxiliary hose of an adjacent coupled rail car comprising a rail car body having opposite ends and a center sill extending along a longitudinal axis;

an air line being mounted on said rail car body;

said air line having a pair of hose connection ends at each of said ends of said rail car body;

said pair of hose ends is mounted at an upper position of said car body above the other of said hose ends at each end of the car body;

said air line extending between said ends of said car body and being arranged to be in fluid communication with said pair of hose connection ends at each of said ends of said rail car body;

said other of said hose connection ends being connected to said air line; and a pair of vertical air lines for connecting said one of said connection ends to said air line at each end of the car body.

4. The rail car according to claim 3, wherein said other of said pair of hose connection ends forms the ends of said air line.

5. The rail car according to claim 4 further comprising valve means for alternately controlling flow through said pair of hose connection ends.

6. In a rail car comprising a car body having an auxiliary pneumatic line for operating rail car systems, said car body having opposite ends and said car body having upper and lower connection ends at said opposite ends in fluid communication with said auxiliary pneumatic line respectively at said opposite ends of said car body; and means to selectively connect one of said upper and lower connection ends to an external hose for fluid connection therebetween while closing the other of said upper and lower connection end for preventing fluid communication therewith.

* * * * *